United States Patent [19]

Goodin

[11] Patent Number: 4,823,924

[45] Date of Patent: Apr. 25, 1989

[54] APPARATUS TO REINFORCE THE FRAME OF LUGGAGE

[75] Inventor: John W. Goodin, Mission Viejo, Calif.

[73] Assignee: Skyway Luggage Company, Seattle, Wash.

[21] Appl. No.: 123,899

[22] Filed: Nov. 23, 1987

[51] Int. Cl.[4] ..... A45C 13/04; A45C 13/10; A45C 13/36

[52] U.S. Cl. ..... 190/119; 190/121; 190/122; 190/123; 190/127; 70/67; 70/69; 292/DIG. 42; 292/DIG. 48

[58] Field of Search ..... 190/100, 28, 119–123, 190/124, 127; 150/120, 128; 70/63, 67, 69; 292/DIG. 42, DIG. 48

[56] References Cited

U.S. PATENT DOCUMENTS

| | | | |
|---|---|---|---|
| 3,294,206 | 12/1966 | Gehrie | 190/121 |
| 3,557,917 | 1/1971 | Kaplan | 190/121 |
| 3,780,838 | 12/1973 | Slan | 190/121 |
| 4,094,392 | 6/1978 | Gregg et al. | 190/120 |
| 4,199,045 | 4/1980 | Machler | 190/121 |
| 4,509,622 | 4/1985 | Morszeck | 190/119 |

*Primary Examiner*—Sue A. Weaver
*Attorney, Agent, or Firm*—Seed and Berry

[57] ABSTRACT

A doubler channel is provided for the main top wall support frame in a carrying case. The doubler channel extends vertically a substantial distance for increasing the beam strength of the top walls of the carrying case. A latch mechanism is proivided wholly outside of the support frame of the top wall of the carrying case. The support frame and doubler channel are all easily assembled without the need for screws or nuts and bolts. The latch mechanism conceals and anchors the ends of the doubler channel.

14 Claims, 2 Drawing Sheets

APPARATUS TO REINFORCE THE FRAME OF LUGGAGE

TECHNICAL FIELD

This invention pertains to carrying cases, and more particularly, to attaché cases, briefcases or suitcases in which large vertical loads are placed on the upper top wall structure of the case by the handle when the case is heavily loaded. In addition, the invention pertains to the technique by which the locking mechanism is connected to the case.

BACKGROUND ART

A problem with conventional carrying cases is that the beam strength of the top walls of the carrying case when the halves are closed and locked together can be exceeded by heavy loads in the case. This will deform the top walls, making the halves of the case not close smoothly together. This is normally solved by fattening the frame to provide needed top wall strength. The current technology forces this frame fattening to go all around the case, adding weight but over-strengthening the side walls (where there is little stress) and bottom walls (which are usually reinforced with wood).

A second problem with conventional carrying cases is that the locking mechanism generally protrudes into the interior of the carrying case so that it forms an obstruction to the contents being carried in the case. The locking mechanism also passes through an opening cut into the top frame of the case, weakening the frame.

DISCLOSURE OF THE INVENTION

It is an object of this invention to provide a frame for the top walls of a carrying case which gives considerable increased beam strength to the upper walls only for supporting heavier loads within the case, without adding unnecessary weight to the side and bottom walls.

It is another object of this invention to provide a support frame for the top wall of a carrying case in which the locking mechanism is housed completely outside of the case so that it is not exposed to the interior of the case nor requires the frame have a large opening to receive the locking mechanism.

Basically, the first objective is achieved by connecting a doubler channel to the support frame of the top wall of the fixed half of the case. The doubler channel has a substantial, vertical cross section to increase the beam strength of the support frame near the handle, where the carrying loads are applied. The doubler channel is preferably snapped into mating recesses in the support frame for ease of assembly. Preferably, the ends of the doubler channel are concealed and held by the cover closures or latch mechanism on the top wall. The increased cross section near the handle advantageously allows the remainder of the top support frame to be made lighter, if desired.

The doubler channel may be used with a lock, such as a combination or key lock, although simpler closures, such as latches without a lock, may also be used. The interengaging latch members of the top wall of the movable case half will interengage with the lock of the latch mechanism on the top wall of the fixed case half.

If a lock is used, the lock is outside of the support frame so that the lock does not protrude into the interior of the case or require that a large hole be cut in the support frame.

BEST MODE FOR CARRYING OUT THE INVENTION

Figure 1:
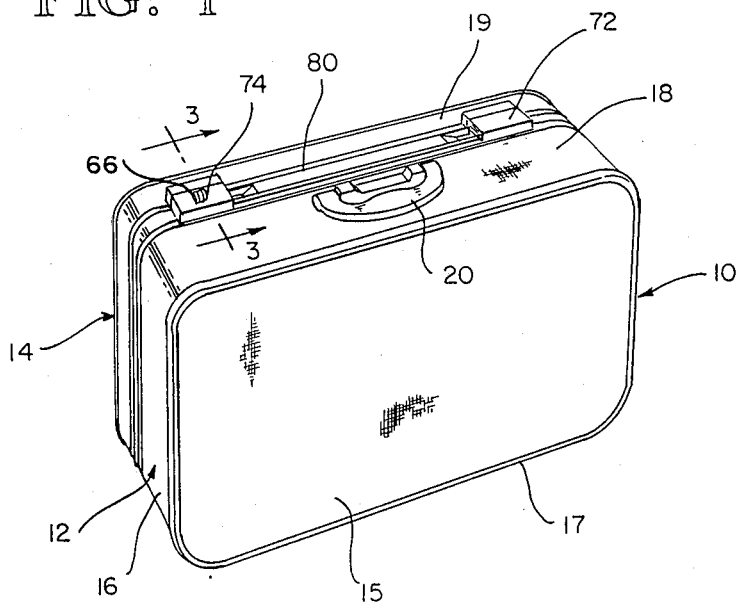
FIG. 1 is an isometric of a typical carrying case embodying the principles of the invention.

The carrying case 10 is provided with a fixed case half 12 and a movable case half or cover 14. Both case halves have side walls 15, end walls 16, and bottom walls 17. The fixed case half is provided with a top wall 18. The movable case half is provided with a top wall 19. A carrying handle 20 is pivotally secured to the top wall 18.

Figure 3:
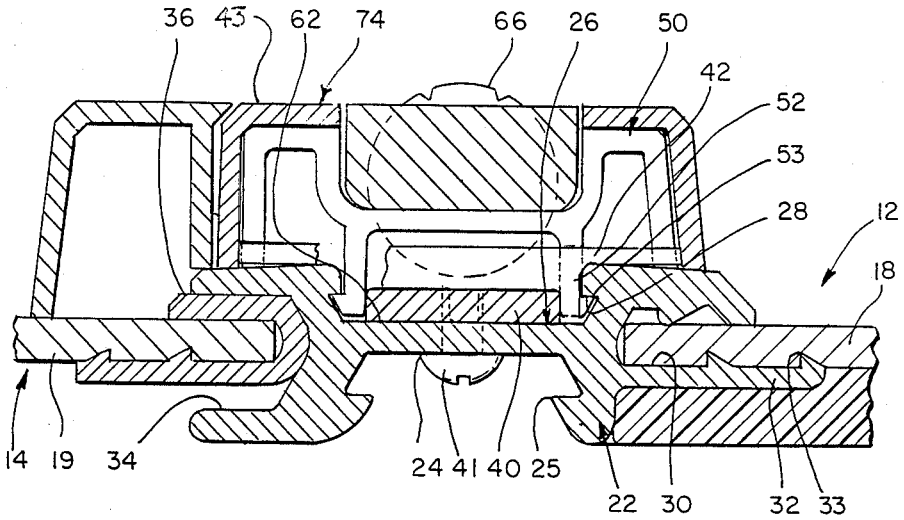
FIG. 3 is a fragmentary transverse section taken along the line 3—3 of FIG. 1.

The fixed case half 12 is provided with a closure frame, or support frame, 22 having an inner recess 24 formed by protruding ledges 25. The support frame has an outer recess 26 formed by protruding ledges 28 and a central web 62. The support frame has a groove 30 formed from bendable legs 32. These legs have hooks 33. During assembly, the legs 32 are bent by rolling them into the position shown in FIG. 3, with the hooks digging into and permanently securing the top wall 18 to the closure frame. The opposite side of the closure frame has a groove 34. This groove is smooth and receives a tongue 36 that is crimped and permanently secured to the top wall 19 of the movable case half 14.

A unique doubler channel 50 is provided with a substantial vertical cross section terminating downwardly at a pair of legs 52 having hooks 53. The legs 52 can elastically deform slightly so that the doubler channel can be pressed into the recess 26 in the closure frame, thus snapping and locking into place. The substantial vertical cross section gives beam strength to the top wall of the carrying case.

The support frame is provided with closures or latch mechanisms 72 and 74. The latch mechanisms each have a flat plate 40 that spans between and is integral with opposite end frames 42 that are integrally joined to an upper latch or closure frame 43. Screws 41 secure the flat plate and thus the latch mechanism to the support frame 22.

Figure 2:
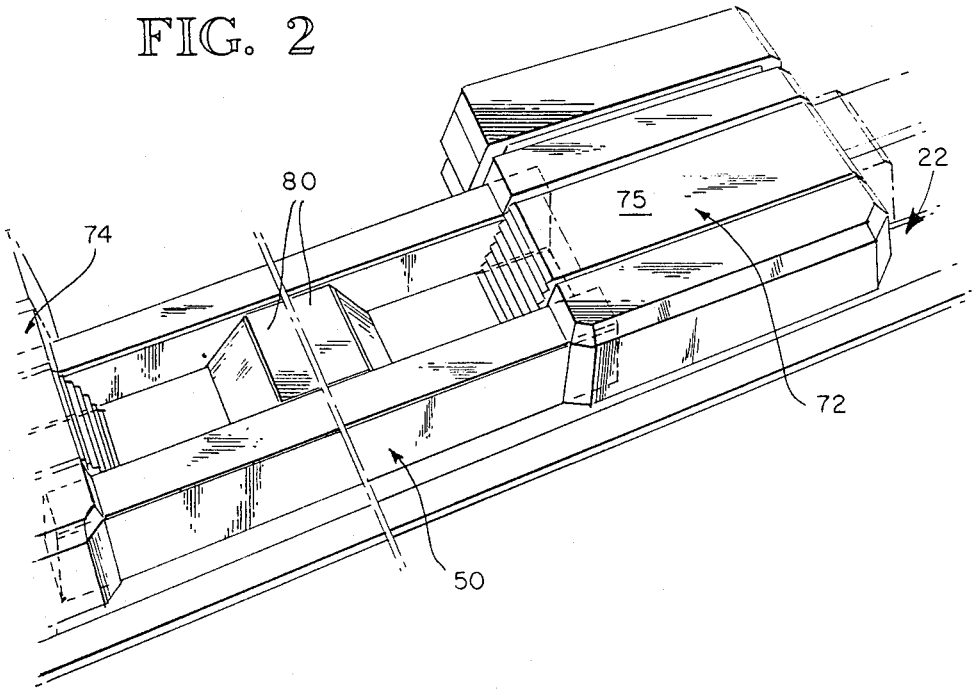
FIG. 2 is a fragmentary isometric of the top portion of the carrying case shown in FIG. 1.

The latch mechanisms overlap the ends of the doubler channel 50 and thus help to anchor the channel against end and upward movement. The latch mechanisms also conceal the ends of the doubler channel as best shown in FIG. 2. The latch mechanisms may have locks, if desired. The locks can be a key, or preferably a combination tumbler 66 as shown. The locks are well known in the art, the details of which need not be described for an understanding of the invention. It is important, however, that the latch mechanism and the locks are housed completely outside of the support frame 22. The recess 26 allows the lock to be surface-mounted without a large penetration of the frame. This allows the area within the case to be unobstructed for holding larger objects. As is thus shown in FIG. 3, the locking combination tumblers 66 of the lock do not protrude into the interior of the case. Furthermore, since neither the latch mechanism nor the lock passes through the support frame, the structural integrity of the support frame is not weakened. (The screws that hold the latch mechanism are an insubstantial penetration of the support frame).

The doubler channel is preferably covered by a plastic filler 80 for appearance. The filler is heat-staked to the channel in a conventional manner. As best shown in FIG. 2, the latch mechanisms 72 and 74 are each provided with a slider 75 fitted into the support frame 22. The slider has movement for unlatching the latch mechanism, with the movement preferably limited to a lengthwise extent which is less than the overlap of the ends of the doubler channel so that the doubler channel is not exposed even when the slider is shifted.

While one latch mechanism with a lock is illustrated for purposes of description, it should be understood that conventional non-locking latch mechanisms may be provided.

As is readily apparent, no screws or bolts are used in the connection of the support frame 22 or the doubler channel to the carrying case. This greatly facilitates the speed and ease of assembly, thus reducing manufacturing costs. The doubler channel greatly increases the beam strength of the top walls of the carrying case. The doubler channel uniquely houses the latch mechanism outside of the interior of the carrying case.

While the detailed embodiments of the invention have been illustrated and described, it should be apparent that variations will be apparent to one of ordinary skill in the art. Accordingly, the invention is not to be limited to the specific illustration shown in the drawing.

I claim:

1. A carrying case having first and second case halves hinged together and each case half having a lengthwise edge, top, bottom, side and end walls, the top walls interfitting when the case is closed and having spaced latch mechanisms and a carrying handle, a support frame encircling the first case half, said support frame including means on one side for securing the support frame to one lengthwise edge of the top wall of a first case half, and a strengthening doubler channel fitted into the top of the support frame, said doubler channel having a substantial vertical cross section extending upwardly above the support frame for providing beam strength in the center of the top of the case.

2. The carrying case of claim 1, a latch mechanism having a lock, the support frame having an upper recess defined by a central web and side ledges, the lock lying in the support frame recess on the outside of the central web.

3. The carrying case of claim 1, said doubler channel having lower, transversely spaced connecting legs, each having a laterally outwardly protruding hook, said support frame having a central upper recess formed by protruding ledges, said hooks snapping over said ledges and being retained thereby.

4. The carrying case of claim 1, said doubler channel having an elongated upper central recess, a filler member secured in said recess and filling most of the recess but leaving finger recesses adjacent each latch mechanism, the doubler channel having opposite ends concealed by said latch mechanisms, each latch mechanism having a sliding latch movable lengthwise outwardly to unlatch the second case half top wall, said sliding latch movement being less than the overlapped concealed end of the doubler channel so that the end of the doubler channel is not exposed when opening the latch mechaism.

5. The carrying case of claim 4, said support frame having a central upper recess having a central web, said latch mechanisms having locks, the locks lying completely outside the central web of the support frame, said doubler channel having lower, transversely spaced connecting legs, each having a laterally outwardly protruding hook, said support frame central upper recess having protruding ledges, said hooks snapping over said ledges and being retained thereby.

6. The carrying case of claim 4, said latch mechanisms preventing the ends of the doubler channel from being pulled out of said support frame central upper recess.

7. The carrying case of claim 1, said spaced latch mechanisms secured to said support frame, said latch mechanisms overlying and anchoring the ends of the doubler channel within the support frame.

8. A carrying case having fixed and movable case halves, each with a top wall, a carrying handle secured to the fixed case half top wall, the fixed case half having an elongated support frame, the support frame having an upper recess defined by a central web, a strengthening member secured within said upper recess, said strengthening member extending vertically outwardly beyond the top of said support frame for increasing the beam strength of the support frame from vertical loads applied by the carrying handle when the case is being carried.

9. The carrying case of claim 8, said support frame including a latch mechanism, said latch mechanism being wholly contained on the outside of said central web of said elongated support frame so as not to protrude into the carrying space within the carrrying case.

10. The carrying case of claim 9, said support frame having a groove along one side for releasibly receiving the movable case half top wall, and a groove with prongs on the fixed case half side for crimpingly securing the support frame permanently to the top wall of the fixed case half.

11. The carrying case of claim 8, including longitudinally spaced latch mechanisms secured to said support frame and overlying the ends of said strengthening member for concealing and anchoring the ends of the strengthening member.

12. The carrying case of claim 8, said support frame upper recess having inwardly protruding ledges, said strengthening member having outwardly extending hooks that are snapped into said upper recess and held by said recess inwardly protruding ledges.

13. The carrying case of claim 1, said support frame having a central upper recess, wherein the doubler channel fits within said recess and extends laterally outwardly overlying the support frame beyond said recess.

14. The carrying case of claim 1, said carrying handle having opposite ends, said doubler channel extending lengthwise beyond the opposite ends of said handle.

* * * * *